US005089801A

United States Patent [19]

Chan et al.

[11] Patent Number: 5,089,801

[45] Date of Patent: Feb. 18, 1992

[54] SELF-REGULATING PTC DEVICES HAVING SHAPED LAMINAR CONDUCTIVE TERMINALS

[75] Inventors: Chi-Ming Chan, Cupertino; Shou-Mean Fang, Union City, both of Calif.

[73] Assignee: Raychem Corporation, Menlo Park, Calif.

[21] Appl. No.: 590,114

[22] Filed: Sep. 28, 1990

[51] Int. Cl.[5] ..... H01C 7/10

[52] U.S. Cl. ..... 338/22 R; 338/225 D; 29/610.1; 29/612; 219/553; 219/505

[58] Field of Search ..... 338/22 R, 225 D; 29/610.1, 612; 219/549, 553, 505

[56] References Cited

U.S. PATENT DOCUMENTS

| | | | |
|---|---|---|---|
| 3,617,816 | 11/1971 | Riseman et al. | 338/22 R X |
| 4,237,441 | 12/1980 | van Konynenburg et al. | 338/22 |
| 4,238,812 | 12/1980 | Middleman et al. | 361/106 |
| 4,255,698 | 3/1981 | Simon | 320/35 |
| 4,272,471 | 6/1981 | Walker | 264/104 |
| 4,304,987 | 12/1981 | van Konynenburg | 219/553 |
| 4,315,237 | 2/1982 | Middleman et al. | 338/22 |
| 4,317,027 | 2/1982 | Middleman et al. | 219/553 |
| 4,330,703 | 5/1982 | Horsma et al. | 219/553 |
| 4,388,607 | 6/1983 | Toy et al. | 338/22 |
| 4,426,633 | 1/1984 | Taylor | 338/25 |
| 4,475,138 | 10/1984 | Middleman et al. | 361/58 |
| 4,514,620 | 4/1985 | Cheng et al. | 219/553 |
| 4,534,889 | 8/1985 | van Konynenburg et al. | 252/511 |
| 4,545,926 | 10/1985 | Fouts, Jr. et al. | 252/511 |
| 4,560,498 | 12/1985 | Horsma et al. | 252/511 |
| 4,591,700 | 5/1986 | Sopory | 219/505 |
| 4,654,511 | 3/1987 | Horsma et al. | 338/22 R X |
| 4,689,475 | 8/1987 | Matthiesen | 219/553 |
| 4,724,417 | 2/1988 | Au et al. | 338/22 |
| 4,774,024 | 9/1988 | Deep et al. | 252/511 |
| 4,780,598 | 10/1988 | Fahey et al. | 219/511 |
| 4,800,253 | 1/1989 | Kleiner et al. | 219/553 |
| 4,845,838 | 7/1989 | Jacobs et al. | 29/671 |
| 4,904,850 | 2/1990 | Claypool et al. | 338/22 SD X |
| 4,907,340 | 3/1990 | Fang et al. | 29/610.1 |
| 4,924,074 | 5/1990 | Fang et al. | 219/548 |
| 4,954,696 | 9/1990 | Ishii et al. | 338/22 R |

FOREIGN PATENT DOCUMENTS 0038713 4/1981 European Pat. Off. .

*Primary Examiner*—Marvin M. Lateef

*Attorney, Agent, or Firm*—Marguerite E. Gerstner; Timothy H. P. Richardson; Herbert G. Burkard

[57] ABSTRACT

An electrical device in which a conductive terminal is physically and electrically attached to a laminar resistive element by means of a laminar conductive element. The three layers are positioned in such a way that the periphery of the conductive element does not extend beyond the first periphery and at least a part of the periphery of the conductive terminal lies within the first periphery. In a preferred embodiment the conductive element is solder and the periphery of the conductive terminal is shaped in such a way that no excess solder bridges from one laminar surface of the resistive element to the other. Devices of the invention are useful as circuit protection devices.

12 Claims, 1 Drawing Sheet

SELF-REGULATING PTC DEVICES HAVING SHAPED LAMINAR CONDUCTIVE TERMINALS

BACKGROUND OF THE INVENTION

1. Field of the Invention

This invention relates to electrical devices and methods for making them, particularly electrical devices which are suitable for use as circuit protection devices.

2. Introduction of the Invention

Electrical devices for use in protecting against overvoltage or over-temperature conditions in a circuit are well known. Such circuit protection devices frequently comprise materials which exhibit a positive temperature coefficient of resistance, i.e. PTC behavior, and thus act to shut down a circuit if conditions are unsafe by increasing in resistance by orders of magnitude from a normal, low temperature value. Devices of this type may comprise an inorganic material, e.g. $BaTiO_3$, or a conductive polymer composition. For any material, the time required for the device to switch into its high resistance state, i.e. to "trip", is a function of the resistivity of the material, the geometry of the device, and the thermal environment. It is generally preferred that the resistance of the device at 23° C. be as low as possible in order to contribute as little resistance as possible to the circuit during normal, low temperature operation. For most low voltage applications, i.e. 60 volts or less, devices of planar geometry are preferred. Such planar devices comprise a laminar resistive element which is electrically connected to two laminar electrodes. For a material of a given resistivity, planar devices of specified area will have the lowest resistance when the distance between the electrodes, i.e the current path length, is the smallest. Therefore, thin devices are preferred and result in lower resistances, lower materials requirements, and smaller "real estate" requirements for a printed circuit board.

There are problems, however, with thin laminar devices. When the device trips into its high resistance state, heat is generated by I2R heating. Because of the relatively small thermal mass of a thin device, it tends to dissipate the heat rapidly and to trip rapidly. Such rapid tripping is not desirable for all applications. For example, when a device is designed to protect a motor used to raise or lower a window, the device heats as the motor operates. It is necessary that the window be fully opened or closed before the device heats sufficiently to cause it to trip. Therefore, a relatively long trip time is needed when compared to many conventional applications. One technique to increase the trip time is to increase the thermal mass by electrically and physically attaching elements of high thermal mass, e.g. metal terminal plates, to the device. The most common technique for connecting the thermal elements to the laminar device is to solder them into position, e.g. by applying a solder paste to either the thermal element or the laminar device or both, heating the solder paste to cause it to flow, and then cooling the solder to attach the thermal element to the laminar device. If there is excess solder, during the reflow operation, it may be forced out from under the thermal element and bridge across the resistive element from one laminar electrode to the other. As a result, during operation there will be failure of the device as an electrical short occurs.

SUMMARY OF THE INVENTION

The tendency for an electrical short to form between the terminals can be decreased by increasing the distance from one terminal to the other. This can be accomplished by using a laminar device which has a larger distance and thus a longer current path between the electrodes, i.e. a greater thickness. To maintain a low resistance with a greater thickness, however, the resistivity of the material for a device of this type would need to be very low, often lower than is commercially feasible. Alternatively, reservoirs for excess solder can be provided by moving the terminals away from the edge of a device and/or by cutting holes in the terminals. However, this procedure may not be desirable because those sections of the device not in contact with the terminal are subject to undesirable thermal effects, e.g. formation of a hot zone or an area of higher current concentration, which can result in device failure. In addition, it is undesirable to have a significant portion of a laminar device exposed due to the possibility of mechanical damage to the device. We have now discovered that if the edges of the terminals of a device are notched or otherwise indented, and the indentations on one of the terminals are staggered with respect to the indentations on the other terminal, this has relatively little thermal effect on the device, but yet provides reservoirs along the periphery of the device into which excess solder or other conductive paste can flow. This prevents the solder from flowing over the edge of the resistive element to cause a solder bridge. The staggered indentations can be present around part or all of the periphery of the device.

In a first aspect, this invention relates to an electrical device which comprises (1) a laminar resistive element which
  (a) is composed of a first material having a first resistivity at 23° C., and
  (b) has a first periphery;
(2) a laminar conductive element which
  (a) is secured to a face of the resistive element,
  (b) is composed of a second material having a second resistivity at 23° C. which is substantially lower than the first resistivity, and
  (c) has a second periphery which does not extend beyond the first periphery; and
(3) a conductive terminal comprising a laminar portion which
  (a) is secured to a face of the conductive element remote from the resistive element,
  (b) is composed of a third material having a third resistivity at 23° C. which is substantially lower than the first resistivity, and
  (c) has a third periphery at least a part of which lies within the first periphery.

In a second aspect, this invention relates to a circuit protection device which comprises (1) a laminar resistive element which
  (a) is composed of a conductive polymer composition and
  (b) has a first periphery;
(2) two laminar electrodes which are attached to opposite surfaces of the resistive element, each of which electrodes
  (a) is composed of metal, and
  (b) has a periphery which coincides with the first periphery;
(3) two conductive elements, each of which (a) comprises solder,
(b) has a second periphery which does not extend beyond the first periphery, and
(c) is attached to a face of one of the laminar electrodes remote from the resistive element; and (4) two conductive terminals, each of which
(a) is composed of metal,
(b) has a third periphery, at least a part of which lies within the first periphery,
(c) is attached to a laminar surface of one of the conductive elements remote from one of the laminar electrodes.

In a third aspect, this invention relates to a method of making a an electrical device which comprises (1) providing a laminar resistive element which
(a) is composed of a conductive polymer composition,
(b) has a first periphery, and
(c) is attached on opposite surfaces to two laminar electrodes, each of which (i) is composed of metal and (ii) has a periphery which coincides with the first periphery;

(2) applying a conductive paste to a face of each of the laminar electrodes;

(3) positioning onto the conductive paste in a selected position a conductive terminal which
(a) is composed of metal, and
(b) has a third periphery which has an irregular shape comprising notches, wherein at least a part of the third periphery lies within the first periphery; and (4) attaching the terminals to the electrodes so that excess conductive paste is forced from under each terminal into the notches.

DETAILED DESCRIPTION OF THE INVENTION

Figure 1:
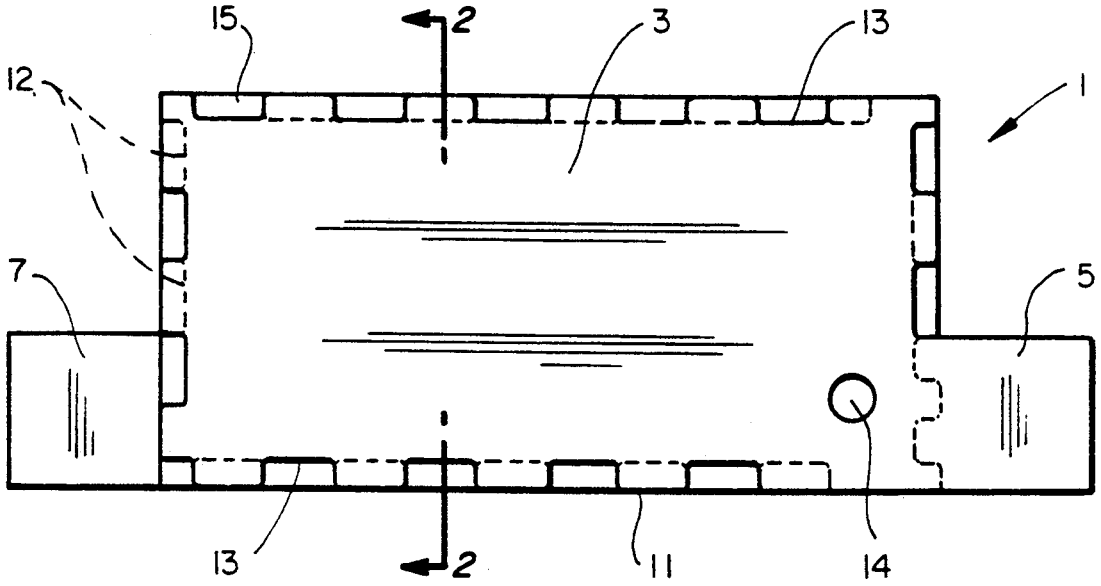
FIG. 1 shows a plan view of a device of the invention.

The electrical device of the invention comprises a laminar resistive element which may be of any shape, e.g. rectangular, round, or square, and which has a first periphery, i.e. the maximum distance around the edge (the perimeter) of the element. The resistive element is composed of a first material having a first resistivity at 23° C. Suitable materials include inorganic compositions such as $BaTiO_3$, and conductive polymer compositions. Such conductive polymer compositions comprise a particulate conductive filler which is dispersed or otherwise distributed in a polymeric component. The polymeric component may be an organic polymer, preferably a crystalline organic polymer, an amorphous thermoplastic polymer, an elastomer, or a blend comprising one or more of these. Suitable crystalline polymers include polymers of one or more olefins, particularly polyethylene; copolymers of at least one olefin and at least one monomer copolymerisable therewith, such as ethylene/acrylic acid, ethylene/ethyl acrylate, and ethylene/vinyl acetate copolymers, melt-shapeable fluoropolymers such as polyvinylidene fluoride; and blends of two or more such crystalline polymers. Dispersed or distributed in the polymeric component is a particulate conductive filler which may be, for example, carbon black, graphite, metal, metal oxide, particulate conductive polymer, or a combination of these. The quantity of conductive filler needed is based on the required resistivity of the first material which depends on the desired application and the geometry of the electrical device. When, as is preferred, the device functions as a circuit protection device, a resistance at 23° C. of 0.001 to 100 ohms is usually required. For this type of application, when the first material is a conductive polymer composition, the resistivity at 23° C. is 0.001 to 1000 ohm-cm, preferably 0.005 to 500 ohm-cm, particularly 0.01 to 100 ohm-cm, e.g. 0.1 to 25 ohm-cm.

When the first material comprises a conductive polymer composition, additional components such as inert fillers, antioxidants, chemical crosslinking agents, stabilizers, or dispersing agents may be present.

For many applications, it is desirable that the first material exhibit PTC behavior. The term "PTC behavior" is used in this specification to denote a composition or an electrical device which has an $R_{14}$ value of at least 2.5 and/or an $R_{100}$ value of at least 10, and it is particularly preferred that the composition should have an $R_{30}$ value of at least 6, where $R_{14}$ is the ratio of the resistivities at the end and the beginning of a 14° C. temperature range, $R_{100}$ is the ratio of the resistivities at the end and the beginning of a 100° C. range, and $R_{30}$ is the ratio of the resistivities at the end and the beginning of a 30° C. range. When the first material is a conductive polymer composition which exhibits PTC behavior, crystalline organic polymers are preferred. Suitable conductive polymer compositions may be found in U.S. Pat. Nos. 4,237,441 (van Konynenburg et al), 4,304,987 (van Konynenburg), 4,388,607 (Toy et al), 4,514,620 (Cheng et al), 4,534,889 (van Konynenburg et al), 4,545,926 (Fouts et al), 4,560,498 (Horsma et al), 4,591,700 (Sopory), 4,724,417 (Au et al), and 4,774,024 (Deep et al), and pending, commonly assigned U.S. application Ser. No. 06/141,989 (Evans), filed Apr. 21, 1980. The disclosure of each of these patents and applications is incorporated herein by reference.

A laminar conductive element is secured to the surface of the resistive element so that there is physical and electrical contact between the two elements. The conductive element is composed of a second material having a second resistivity at 23° C. which is substantially lower than the first resistivity. In this application, when a material is said to have a resistivity which is substantially lower than the first material, it means that the resistivity is at least 10 times less, preferably at least 50 times less, particularly at least 100 times less than the resistivity of the first material at 23° C. The conductive element has a second periphery which does not extend beyond the first periphery, i.e. it may be entirely within the first periphery or may coincide with the first periphery. It is also preferred that the second material be thermally conductive in order to enhance the flow of heat from the resistive element to the conductive terminal. Many conductive materials may be used for the conductive element, e.g. conductive inks, conductive pastes, or conductive epoxies. For many applications, however, it is preferred that the second material is solder, which can be readily applied, attached to and form an electrical connection between the laminar resistive element and the conductive terminal. The appropriate type of solder depends on the properties of the material comprising the resistive element. For example, a tin eutectic solder which can be melted and reflowed at a relatively low temperature, is suitable for use with conductive polymer resistive elements comprising polyethylene. Other, higher melting solders, such as silverbased solders, may be used with resistive elements comprising higher melting polymers or inorganic materials. When solder is used, it may be applied to either the surface of the resistive element (or any attached electrode) or the surface of the conductive terminal, or both, preferably in the form of solder paste. The composite is then heated in a solder reflow furnace (which may be an infrared oven, a hot air oven, or a vapor phase reflow oven) to melt and reflow the solder. After the solder is cooled, a bond is formed between the various elements.

The conductive terminal comprises a laminar portion which is secured to a face of the conductive element remote from the resistive element and which is composed of a third material having a third resistivity at 23° C. which is substantially lower than the first resistivity. The conductive terminal is preferably a laminar metal sheet which comprises one or more metal layers, although for some applications, it may be a metal mesh or screen, a fabric containing a metal fiber, or a layer formed from a conductive ink. When the terminal is a metal sheet, the type of metal depends on the thermal, electrical, environmental, and cost requirements for the device. Different layers may be present in order to meet different requirements and it is often preferred that the interior surface layer, i.e. that surface in contact with the conductive element, and the exterior surface layer be different. For example, devices which are to be soldered to a circuit board or to another component may require an exterior surface layer of copper, brass, or tin, while devices to be welded would require copper rather than tin which would contaminate the welding electrodes. For devices to be used in a corrosive environment, nickel may be suitable. A preferred terminal comprises copper-coated steel. It is also possible that the shape and/or texture of the interior and exterior surface layers be different in order to meet different requirements. Thus one surface may be an electrodeposited layer which comprises nodules suitable for enhanced adhesion to the conductive element and the other surface may have "fins" for improved convection of heat from the device.

The thickness of the terminal is also affected by the thermal requirements of the device. In general, it is preferred that the terminal have a thickness of at least 0.002 inch (0.005 cm), preferably at least 0.005 inch (0.0127 cm), particularly at least 0.010 inch (0.025 cm), especially at least 0.015 inch (0.038 cm), e.g. 0.020 inch (0.051 cm), but that it have a thickness of less than 0.100 inch (0.254 cm), preferably less than 0.080 inch (0.203 cm), in order to prevent the restriction of any necessary expansion of the resistive element. If fins are present on one surface of the terminal, the thickness does not include the height of the fin.

The conductive terminal has a third periphery, at least a part of which lies within the first periphery. For many applications, it is preferred that the majority of the third periphery, i.e. at least 50% of the third periphery, lie within the first periphery. Portions of the third periphery which lie outside the first periphery may be used for making electrical contact from the electrical device to a circuit board or an electrical lead. Therefore, it is common that "tabs" for welding or otherwise connecting the terminal to a source of electrical power, extend beyond the first periphery. The third periphery, which is equivalent to the edge of the conductive terminal, may be shaped in any way which is suitable for the application and which will allow the terminal to be positioned correctly with respect to the resistive element and the conductive element. It is generally desired that the amount of metal in contact with the conductive element be maximized in order to maximize the thermal mass of the device and minimize any areas of high current concentration which result from a nonuniform contact between the terminal and the resistive element (or the electrode attached to the resistive element). Therefore, an effective conductive terminal can be prepared by removing only a small quantity of material from at least part of the edge of the terminal or by positioning the terminal only slightly away from the edge of the resistive element. A suitable terminal can be prepared from a metal sheet which initially has the same dimensions as the resistive element, but which is then treated around at least a part of its edge to remove material in either a regular or irregular pattern. A metal foil can be stamped or die-cut into a suitable shape. For many applications, at least 10%, preferably at least 20%, particularly at least 30% of the terminal edge is notched or indented. In a preferred embodiment, as shown in FIG. 1, material is removed from the edge of the terminal in a regular pattern except in the region of the tab to form rectangular notches. In other embodiments, the pattern at the edge may be scalloped, or otherwise indented. When, as is preferred, the device comprises two conductive terminals, one secured to a conductive element on each laminar face of the resistive element, it is preferred that the first and the second conductive terminals have the same shape but that they each be secured to the conductive element in a selected position. The selected positioning allows the first and the second conductive terminals to be oriented in such a way that when the device is notionally cut into slices in a direction normal to the laminar face of the resistive element, each slice is in contact with at least one conductive terminal over the entire surface of one face. This positioning ensures that the resistive element is in contact with at least one conductive terminal for every slice for the maximum thermal mass. In some designs, one or more vent holes are present in the conductive terminal in order to provide a site for excess solder to flow during the reflow process. If there are two conductive terminals and each contains a vent hole, the vent holes are positioned offset from one another. To avoid adverse thermal effects, the vent holes comprise less than 20%, preferably less than 15%, particularly less than 10% of the surface area of the conductive terminal.

While it is possible to attach the conductive element directly to the resistive element, for most applications it is preferred that the conductive element be attached to a laminar electrode which itself is attached to the resistive element. The laminar electrode is composed of a fourth material having a fourth resistivity at 23° C. which is substantially lower than the first resistivity. The fourth material is generally a laminar metal foil such as copper or nickel, particularly an electrodeposited metal foil which has a nodular surface for enhanced adhesion to a conductive polymer or other substrate. Electrodes of this type, and devices comprising them, are described in U.S. Pat. Nos. 4,689,475 (Matthiesen) and 4,800,253 (Kleiner et al), the disclosures of which are incorporated herein by reference. Alternatively, the laminar electrode may comprise a conductive ink, a conductive epoxy, or a metal layer deposited by flame-spray techniques or vacuum deposition. When two laminar electrodes are secured to the two laminar faces of a resistive element, an electrical device is formed. Devices of this type are disclosed in U.S. Pat. Nos. 4,238,812 (Middleman et al), 4,255,798 (Simon), 4,272,471 (Walker), 4,315,237 (Middleman et al), 4,317,027 (Middleman et al), 4,330,703 (Horsma et al), 4,426,633 (Taylor), 4,475,138 (Middleman et al), 4,724,417 (Au et al), 4,780,598 (Fahey et al), 4,845,838 (Jacobs et al), 4,907,340 (Fang et al), and 4,924,074 (Fang et al), the disclosure of each of which is incorporated herein by reference.

The laminar electrode lies between the resistive element and the conductive element and is secured to both the resistive element and the conductive element. It has a fourth periphery, at least a part of which substantially follows at least a part of the first periphery. For many applications, the fourth periphery does not extend beyond the first periphery, and it is preferred that the fourth periphery coincide with the first periphery.

Devices of the invention can be prepared by a method of the invention in which a conductive material such as a solder paste or conductive epoxy is applied to a laminar surface of the resistive element. A conductive terminal is then positioned on the conductive material in a selected position so that at least part of the third periphery of the conductive terminal lies within the first periphery. For many applications, it is desirable that the selected position be such that, when two conductive terminals are present, there is no section of the first periphery which is not in contact with at least one conductive terminal. The conductive terminal is then electrically and physically attached to the resistive element, e.g. by reflowing and cooling the solder or curing the epoxy.

For some applications, it may be desirable to make the solder flow in a nonuniform manner in order to direct any excess solder into specific reservoirs. Under these conditions, the conductive terminal may be prepared with an indented or notched edge in only a specific region of the periphery. Alternatively, for conductive terminals which comprise a tab for electrical connection, a reservoir or channel at the point where the tab contacts the conductive terminal may be desirable.

The invention is illustrated by the drawing in which FIG. 1 shows a plan view of an electrical device 1. A first terminal 3 comprises an electrical tab 5 to which electrical connections can be made. Also visible is an electrical tab 7 from the second terminal 9. The edge 11 of the first terminal 3 is irregularly shaped and has rectangular notches 13 cut into it. When the conductive layer comprises solder, any excess will be forced out from underneath first terminal 3 into the space created by the rectangular notches 13, thus avoiding solder bridging. The cutout portions of the notches 13 reveal a laminar electrode 15 which is attached to resistive element 19 (not visible). Also shown is a vent hole 14 though which excess solder can flow. Dotted lines indicate the edge 12 of the second terminal 9 which lies underneath first terminal 3.

Figure 2:
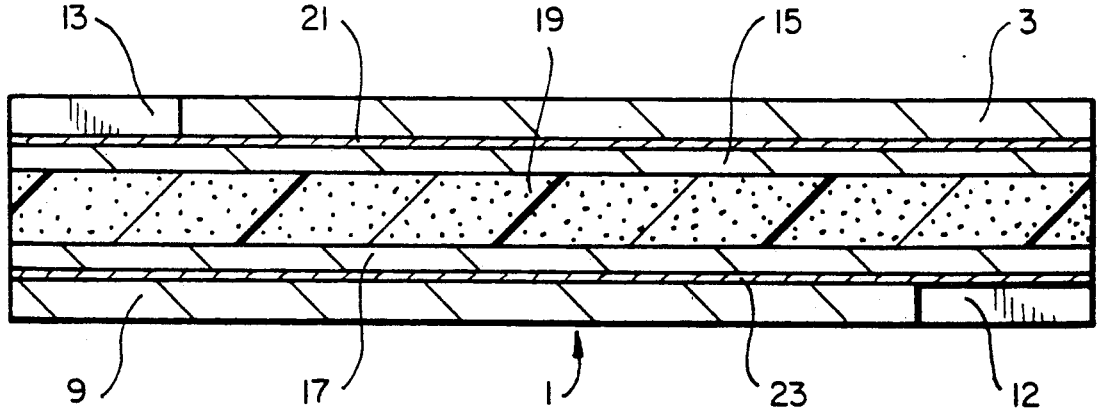
FIG. 2 shows a cross-sectional view of the device of FIG. 1 along line 2—2.

FIG. 2 shows a cross-section of an electrical device 1 taken along line 2—2 of FIG. 1. Resistive element 19 comprises a conductive polymer composition which is attached to laminar electrodes 15,17. Conductive solder paste layers 21,23 physically and electrically attach the laminar electrodes 15,17 to first and second conductive terminals 3,9.

The invention is illustrated by the following example.

EXAMPLE 1

A conductive polymer composition is prepared by preblending 48.6% by weight high density polyethylene (Petrothene LB832, available from USI) with 51.4% by weight carbon black (Raven 430, available from Columbian Chemicals). The blend is mixed in a Banbury mixer, and the resulting composition is extruded through a 2.5 inch (6.35 cm) extruder to form a sheet with a thickness of 0.010 inch (0.025 cm). The sheet is laminated on each side with 0.001 inch (0.0025 cm) thick electrodeposited nickel foil (available from Fukuda) and the laminate is irradiated to a dose of 10 Mrad using a 4.5 MeV electron beam. Chips with dimensions of 0.39×0.79 inch (1×2 cm) are cut from the irradiated sheet.

Copper-plated steel with a thickness of 0.020 inch (0.051 cm) is cut into pieces shaped as shown in FIG. 1 to form conductive terminals. Each terminal has a maximum dimension of 0.98 inch (2.5 cm) including the 0.20×0.20 inch (0.5×0.5 cm) tab for making electrical connection to the circuit, and a length of 0.39 inch (1 cm). Each edge of the terminal, excluding the tab, is cut to form rectangular-shaped notches with dimensions of 0.070 inch (0.178 cm)×0.021 inch (0.054 cm).

An electrical device is prepared by positioning a first terminal in a fixture, depositing solder paste comprising a Sn 63 eutectic solder on the exposed laminar surface of the terminal, positioning a conductive polymer chip onto the solder paste, depositing solder paste on the exposed laminar surface of the conductive polymer chip, and positioning a second terminal 180° out of phase with the first terminal onto the solder paste. The resulting device has tabs for electrical connection at opposite sides of the device. The fixture is then passed through an oven to heat and reflow the solder, and to attach the terminals to the chip. The mold is cooled and the completed device is removed. No solder "bridges" are observed.

What is claimed is:

1. An electrical device which comprises (1) a laminar resistive element which
  (a) is composed of a first material having a first resistivity at 23° C., and
  (b) has a first periphery;

(2) a laminar conductive element which
  (a) is secured to a face of the resistive element,
  (b) is composed of a second material having a second resistivity at 23° C. which is substantially lower than the first resistivity, and
  (c) has a second periphery which does not extend beyond the first periphery;

(3) a conductive terminal a laminar portion which
  (a) is secured to a face of the conductive element remote from the resistive element,
  (b) is composed of a third material having a third resistivity at 23° C. which is substantially lower than the first resistivity, and
  (c) has a third periphery at least a part of which does not extend beyond the first periphery; and (4) a laminar electrode which
  (a) is composed of a fourth material having a fourth resistivity at 23° C. which is substantially lower than the first resistivity,
  (b) lies between the resistivity element and the conductive element and is secured to the resistive element and the conductive element, and (c) has a fourth periphery which coincides with the first periphery.

2. A device according to claim 1 wherein the first material comprises a conductive polymer which exhibits PTC behavior.

3. A device according to claim 2 wherein the laminar electrode is a metal foil electrode.

4. A device according to claim 1 wherein the first material comprises an inorganic composition.

5. A device according to claim 1 wherein the conductive element is solder.

6. A circuit protection device which comprises (1) a laminar resistive element which
  (a) is composed of a conductive polymer composition which exhibits PTC behavior, and
  (b) has a first periphery;

(2) two laminar electrodes which are attached to opposite surfaces of the resistive element, each of which electrodes
  (a) is composed of metal, and
  (b) has a periphery which coincides with the first periphery;

(3) two conductive elements, each of which
  (a) comprises solder,
  (b) has a second periphery which does not extend beyond the first periphery, and
  (c) is attached to a face of one of the laminar electrodes remote from the resistive element; and (4) a first conductive terminal and a second conductive terminal, each of which
  (a) is composed of metal,
  (b) has a periphery, at least a part of which does not extend beyond the first periphery, and
  (c) is attached to a laminar surface of one of the conductive elements remote from one of the laminar electrodes;

wherein (i) substantially all of the periphery of the first conductive terminal and substantially all of the periphery of the second conductive terminal have an irregular shape which comprises notches, and (ii) the first conductive terminal and the second conductive terminal are positioned in a staggered configuration so that at least part of the periphery of the first terminal does not extend beyond at least part of the periphery of the second terminal and the notches of the first terminal are staggered with the notches of the second terminal.

7. A device according to claim 6 wherein the electrode comprises a metal sheet with an electrodeposited metal surface, which surface is in contact with the resistive element.

8. A device according to claim 6 wherein at least one conductive terminal comprises a vent hole.

9. A method of making an electrical device which comprises (1) providing a laminar resistive element which
  (a) is composed of a conductive polymer composition,
  (b) has a first periphery, and
  (c) is attached on opposite surfaces to two laminar electrodes, each of which (i) is composed of metal and (ii) has a periphery which coincides with the first periphery;

(2) applying a conductive paste to a face of each of the laminar electrodes;

(3) positioning onto the conductive paste in a selected position first and second conductive terminals each of which
  (a) is composed of metal, and
  (b) has a periphery which has an irregular shape comprising notches, wherein at least a part of the periphery of the first conductive terminal and part of the periphery of the second conductive terminal does not extend beyond the first periphery; and (4) attaching the first and second terminals to the electrodes so that excess conductive paste is forced from under each terminal into the notches.

10. A method according to claim 9 wherein the conductive paste comprises a solder.

11. A method according to claim 10 wherein the terminal is attached to the resistive element by means of heating and then solidifying the solder.

12. A method according to claim 10 wherein the two terminals are positioned on opposite surfaces of the laminar electrodes so that the periphery of the first terminal is staggered from the periphery of the second terminal.

* * * * *